US009309026B2

(12) United States Patent
Propes

(10) Patent No.: US 9,309,026 B2
(45) Date of Patent: Apr. 12, 2016

(54) WAX MELT ASSEMBLY

(71) Applicant: Travis Propes, Charleston, SC (US)

(72) Inventor: Travis Propes, Charleston, SC (US)

( * ) Notice: Subject to any disclaimer, the term of this patent is extended or adjusted under 35 U.S.C. 154(b) by 0 days.

(21) Appl. No.: 14/314,732

(22) Filed: Jun. 25, 2014

(65) Prior Publication Data

US 2014/0374415 A1 Dec. 25, 2014

Related U.S. Application Data

(60) Provisional application No. 61/839,272, filed on Jun. 25, 2013.

(51) Int. Cl.
*B65D 21/02* (2006.01)
*B65D 1/36* (2006.01)

(52) U.S. Cl.
CPC ..... *B65D 21/0204* (2013.01); *B65D 1/36* (2013.01)

(58) Field of Classification Search
CPC ..... B65D 21/0204; B65D 21/0201; B65D 21/0206; B65D 1/36; A61L 9/035
USPC ..... 220/23.8, 23.2, 505, 507, 512, 500, 220/553; 422/126; 431/291, 292, 295, 297
See application file for complete search history.

(56) References Cited

U.S. PATENT DOCUMENTS

| | | | | |
|---|---|---|---|---|
| 2,944,696 | A * | 7/1960 | Effgen | 220/507 |
| 3,502,241 | A * | 3/1970 | Smith | 220/23.6 |
| 4,428,493 | A * | 1/1984 | McDonough | 220/555 |
| 2002/0102187 | A1* | 8/2002 | Bellenger et al. | 422/126 |
| 2012/0231401 | A1* | 9/2012 | Hsu | 431/289 |

* cited by examiner

*Primary Examiner* — Fenn Mathew
*Assistant Examiner* — Don M Anderson
(74) *Attorney, Agent, or Firm* — Roeder & Broder LLP; James P. Broder

(57) ABSTRACT

A wax melt assembly includes a plurality of first wax melts, a plurality of second wax melts and a melt retainer. The first wax melts each have a first property. The second wax melts each have a second property that is different than the first property. The melt retainer includes a first compartment, a second compartment and a retainer body. The first compartment retains the first wax melts. The second compartment retains the second wax melts. The retainer body can have a height that extends from a base to a top of the retainer body and can include a plurality of exterior side walls that extend the height of the retainer body. The retainer body can include a compartment separator that extends between the first compartment and the second compartment. The first compartment can include a first sub-compartment that retains one of the first wax melts, and a second sub-compartment that retains another of the first wax melts. The first wax melt in the first sub-compartment and the first wax melt in the second sub-compartment can be connected to one another. The properties can include scents and/or colors.

21 Claims, 2 Drawing Sheets

WAX MELT ASSEMBLY

BACKGROUND

The use of meltable fuel such as wax melts or wax tarts that are melted with a candle warmer or a wax warmer, has recently become popular. The melting wax can create a desired ambience primarily due to the fragrance or aroma that is given off. A user may often wish to create different ambiences, e.g., different aromas, for different situations. Thus, such user may want to purchase different wax melts that can provide different scents or aromas. Unfortunately, traditional packaging only enables the user to purchase wax melts having uniform properties in any single given package.

SUMMARY

The present invention is directed toward a wax melt assembly that can include a plurality of first wax melts, a plurality of second wax melts and a melt retainer. The first wax melts can each have a first property. The second wax melts can each have a second property that is different than the first property. The melt retainer can include a first compartment and a spaced apart second compartment. The first compartment can be adapted to retain the first wax melts. The second compartment can be adapted to retain the second wax melts.

In one embodiment, the melt retainer can include a retainer body. In this embodiment, the retainer body can have a height that extends from a base to a top of the retainer body.

In another embodiment, the retainer body can include a plurality of exterior side walls that extend substantially the entire height of the retainer body. In certain embodiments, the exterior side walls can define the first compartment and the second compartment.

In certain embodiments, the retainer body can further include a compartment separator that extends between the first compartment and the second compartment to maintain the first compartment spaced apart from the second compartment.

In some embodiments, the first compartment can include (i) a first sub-compartment that is adapted to retain one of the first wax melts, and (ii) a second sub-compartment that is adapted to retain another of the first wax melts.

In some embodiments, the first wax melt in the first sub-compartment and the first wax melt in the second sub-compartment can be connected to one another.

Further, the retainer body can include a first interior side wall that defines a portion of the first sub-compartment and a second interior side wall that defines a portion of the second sub-compartment.

In various embodiments, the retainer body can have a height that extends from a base to a top of the retainer body. Each of the first interior side wall and the second interior side wall can extend less than substantially the total height of the retainer body.

In some embodiments, each of the first interior side wall and the second interior side wall can extend between approximately one-half and nine-tenths of the total height of the retainer body.

In certain embodiments, the first interior side wall can be coupled to the second interior side wall.

In another embodiment, the wax melt assembly can also include a plurality of third wax melts having a third property that is different than the first property and the second property. The retainer body can further define a third compartment that is spaced apart from the first compartment and the second compartment. In one embodiment, the third compartment can be adapted to retain the plurality of third wax melts.

In some embodiments, the wax melt assembly can also include one or more third wax melts. In certain such embodiments, the retainer body cam also define a third compartment that is spaced apart from the first compartment and the second compartment. The third compartment can retain the one or more third wax melts. The third wax melts can be retained spaced apart from the first wax melts and the second wax melts within the melt retainer.

In certain embodiments, the first property can include a first scent and the second property can include a second scent that is different than the first scent.

In the alternative or in addition, the first property can include a first color and the second property can include a second color that is different than the first color.

Further, the present invention is also directed toward a method including the steps of (i) retaining a plurality of first wax melts each having a first property in a first compartment of a retainer body; and (ii) simultaneously retaining a plurality of second wax melts each having a second property that is different than the first property in a second compartment of the retainer body that is spaced apart from the first compartment.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
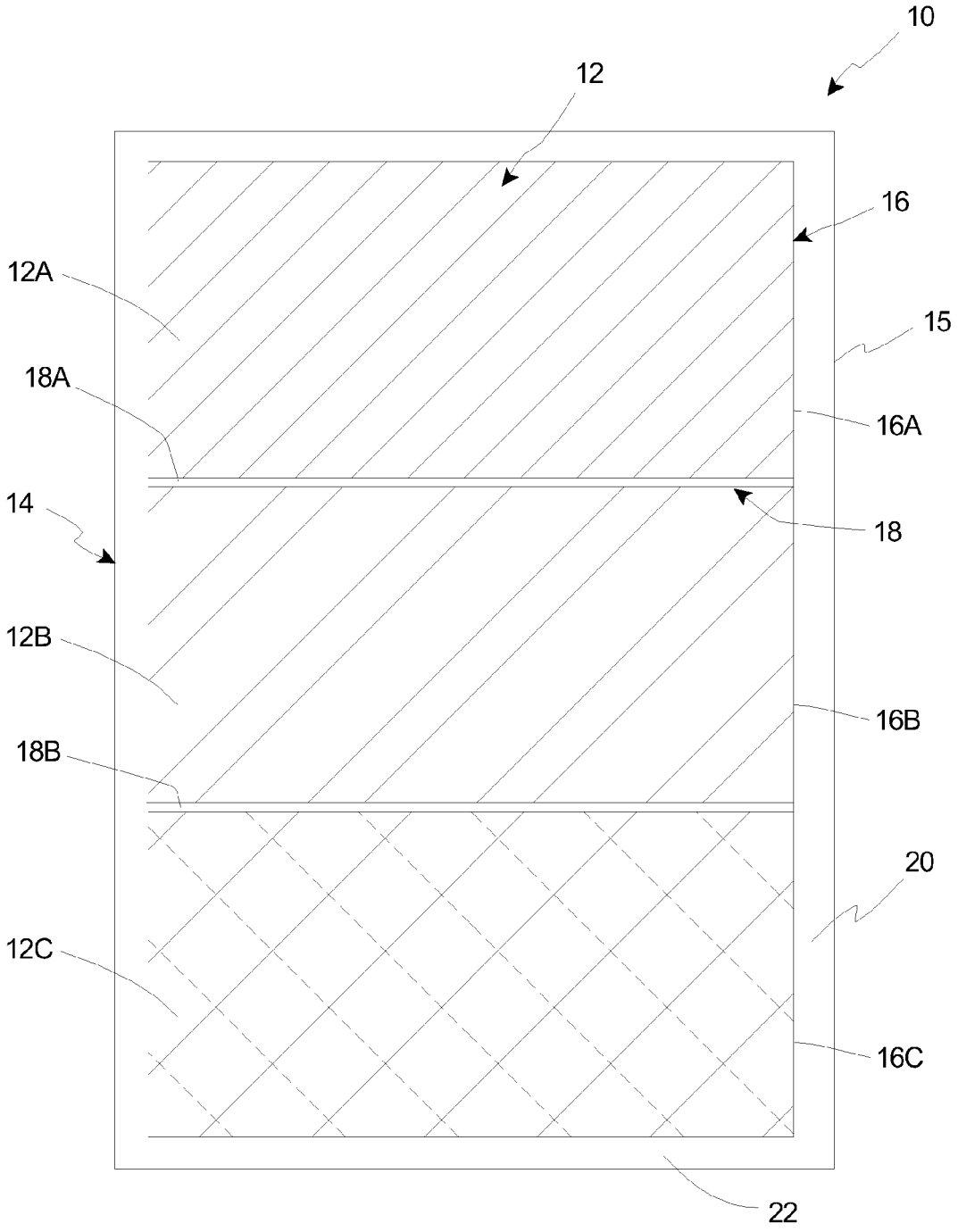
FIG. 1A is a simplified top view of a wax melt assembly having features of the present invention.

FIG. 1A is a simplified top view of a wax melt assembly 10 having features of the present invention. The design of the wax melt assembly 10 can be varied to suit the desires of the consumer. In the embodiment illustrated in FIG. 1A, the wax melt assembly 10 includes a plurality of wax melts 12, and a melt retainer 14 that receives and removably retains the plurality of wax melts 12 prior to use, e.g., prior to the wax melts 12 being removed from the melt retainer 14 and melted in a wax warmer (not shown).

The design of the wax melts 12 can be varied. For example, each of the plurality of wax melts 12 can be formed to be any desired size and shape. Additionally, in different embodiments, the wax melts 12 can be formed from scented wax materials that melt when heated, or the wax melts 12 can be formed from other suitable meltable materials.

As shown in the embodiment illustrated in FIG. 1A, the plurality of wax melts 12 can include one or more first wax melts 12A (illustrated with single diagonal lines), one or more second wax melts 12B (illustrated with double diagonal lines), and one or more third wax melts 12C (illustrated with crisscrossed diagonal lines). Additionally and/or alternatively, in certain non-exclusive alternative embodiments, the plurality of wax melts 12 can further include one or more fourth wax melts, one or more fifth wax melts, one or more sixth wax melts, etc. Still alternatively, the plurality of wax melts 12 can be designed without the one or more second wax melts 12B and/or without the one or more third wax melts 12C.

In certain embodiments, the first wax melts 12A, the second wax melts 12B and the third wax melts 12C can differ from one another in terms of one or more features or characteristics. For example, the first wax melts 12A, the second wax melts 12B and the third wax melts 12C can differ from one another in terms of color and/or scent, such that a single wax melt assembly 10 can include wax melts 12 of differing colors and/or scents. With this design, a single wax melt assembly 10 can at any given time include wax melts 12 having differing colors and/or scents. Stated in another manner, the melt retainer 14 can simultaneously retain wax melts 12 of differing colors and/or scents. By enabling the individual wax melt assembly 10 to simultaneously include wax melts 12 of differing colors and/or scents, the consumer is provided with a greater ability to test out and create desired ambiences with different scents.

Additionally, it should be appreciated that the first wax melts 12A, the second wax melts 12B and/or the third wax melts 12C can also differ from one another in features or characteristics other than color and/or scent. Further, it should also be appreciated that any of the wax melts 12 can differ from any of the other wax melts 12 in terms of shape, size, or other characteristics, e.g., one of the first wax melts 12A can be different than another of the first wax melts 12A in terms of shape or size. Alternatively, the first wax melts 12A, the second wax melts 12B and the third wax melts 12C can be substantially similar to one another in terms of color, scent, size, shape, and/or other characteristics.

As provided above, the melt retainer 14 receives and retains the plurality of wax melts 12. The design of the melt retainer 14 can be varied to suit the specific requirements of the wax melt assembly 10. As shown in the embodiment illustrated in FIG. 1A, the melt retainer 14 can include a retainer body 15 that is substantially rectangle-shaped. Alternatively, the retainer body 15 can be substantially square-shaped, or another suitable shape.

Additionally, in various embodiments, the retainer body 15 can define and/or include one or more compartments 16 that each contains one or more wax melts 12. For example, in the embodiment illustrated in FIG. 1A, the retainer body 15 defines and/or includes a first compartment 16A that retains the one or more first wax melts 12A, a spaced apart second compartment 16B that retains the one or more second wax melts 12B, and a spaced apart third compartment 16C that retains the one or more third wax melts 12C. With this design, the melt retainer 14, i.e. the retainer body 15, can simultaneously receive and retain (i) the one or more first wax melts 12A, (ii) the one or more second wax melts 12B that can be different than the first wax melts 12A, and (iii) the one or more third wax melts 12C that can be different than the first wax melts 12A and/or the second wax melts 12B. In certain alternative embodiments, the retainer body 15 can define and/or include greater than three or less than three compartments. For example, in certain non-exclusive alternative embodiments, the retainer body 15 can define and/or include one, two, four, five, six or another suitable number of compartments.

As shown in FIG. 1A and as noted above, each of the compartments 16 is spaced apart from each of the other compartments 16. More specifically, the retainer body 15 includes a compartment separator 18 that is positioned and/or extends between each pair of adjacent compartments 16. For example, as shown in this embodiment, the retainer body 15 can include a first compartment separator 18A that is positioned and/or extends between the first compartment 16A and the second compartment 16B; and a second compartment separator 18B that is positioned and/or extends between the second compartment 16B and the third compartment 16C. With this design, the one or more first wax melts 12A that are retained within the first compartment 16A are maintained spaced apart from the one or more second wax melts 12B that are retained within the second compartment 16B; and the one or more second wax melts 12B that are retained within the second compartment 16B are maintained spaced apart from the one or more third wax melts 12C that are retained within the third compartment 16C.

Additionally, in one embodiment, each of the compartments 16 can be substantially rectangle-shaped. Alternatively, each of the compartments 16 can be substantially square-shaped, or another suitable shape. Still alternatively, each of the compartments 16 can have a shape and/or size that is different from that of the other compartments 16.

Further, as shown in FIG. 1A, the retainer body 15 can further include a lip 20 that extends in a generally outward direction away from the compartments 16 along a top 22 of the retainer body 15 and around a perimeter of the retainer body 15. The lip 20 can help to provide greater ease in handling the wax melt assembly 10 for the consumer. Alternatively, the retainer body 15 can be designed without the lip 20.

The melt retainer 14, i.e. the retainer body 15, can be made from any suitable materials. For example, the retainer body 15 can be made from one or more of plastic, cardboard, or any other suitable materials. Additionally, in some embodiments, at least a portion of the retainer body 15 can be substantially transparent to enable the consumer to better see the wax melts 12 when they are retained and packaged within the melt retainer 14.

Figure 1B:
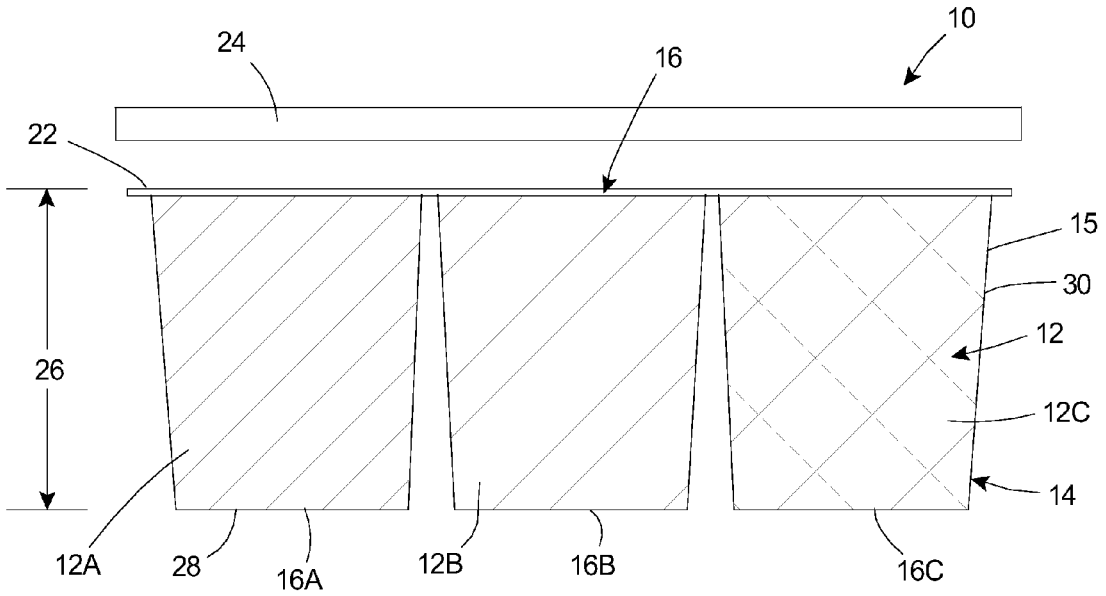
FIG. 1B is a simplified side view of the wax melt assembly illustrated in FIG. 1A and a lid that can be used with the wax melt assembly.

FIG. 1B is a simplified side view of the wax melt assembly 10 illustrated in FIG. 1A. Additionally, FIG. 1B further illustrates that, in certain embodiments, the wax melt assembly 10 can further include a lid 24. Although FIG. 1B illustrates the lid 24 being spaced apart from the retainer body 15, it should be understood that the lid 24 can be positioned around and over the top 22 of the retainer body 15 to better preserve the wax melts 12 within the melt retainer 14 prior to use, e.g., during shipping and storage. The lid 24 can be made from any suitable materials. For example, the lid 24 can be made from one or more of plastic, cardboard, or any other suitable materials. Additionally, in some embodiments, at least a portion of the lid 24 can be substantially transparent to enable the consumer to better see the wax melts 12 when they are retained and packaged within the melt retainer 14.

Further, as illustrated in FIG. 1B, the retainer body 15 can have a height 26 that extends from a base 28 of the retainer body 15 to the top 22 of the retainer body 15. Additionally, as shown, each of the compartments 16 can be tapered somewhat in a downward direction such that the compartment 16 is somewhat smaller or narrower in cross-section at the base 28 of the retainer body 15 as compared to the cross-section at the top 22 of the retainer body 15.

Additionally, FIG. 1B further illustrates the first compartment 16A being spaced apart from the second compartment 16B, and the second compartment being spaced apart from the third compartment 16C. Thus, with this design, the first wax melts 12A (illustrated with single diagonal lines) can be maintained spaced apart from the second wax melts 12B (illustrated with double diagonal lines), and the second wax melts 12B can be maintained spaced apart from the third wax melts 12C (illustrated with crisscrossed diagonal lines).

FIG. 1B further illustrates that each of the compartments 16 includes one or more exterior side walls 30. The exterior side walls 30 help to form the outer boundaries of each of the compartments 16. As utilized herein, an "exterior side wall" is a wall of the compartment 16 that faces and/or is substantially directly adjacent to a wall of an adjacent compartment 16 or forms a portion of the outer perimeter of the retainer body 15. Additionally, as illustrated, each exterior side wall 30 extends substantially the entire distance from the base 28 of the retainer body 15 to the top 22 of the retainer body 15. Stated in another manner, the exterior side walls 30 extend substantially the total height 26 of the retainer body 15. With this design, the exterior side walls 30 better enable the compartments 16, and, thus, the different wax melts 12, to be spaced apart from one another. Additionally, the exterior side walls 30 better enable the positioning of the compartment separators 18 (illustrated in FIG. 1A) between the compartments 16 along the top 22 of the retainer body 15.

Figure 1C:
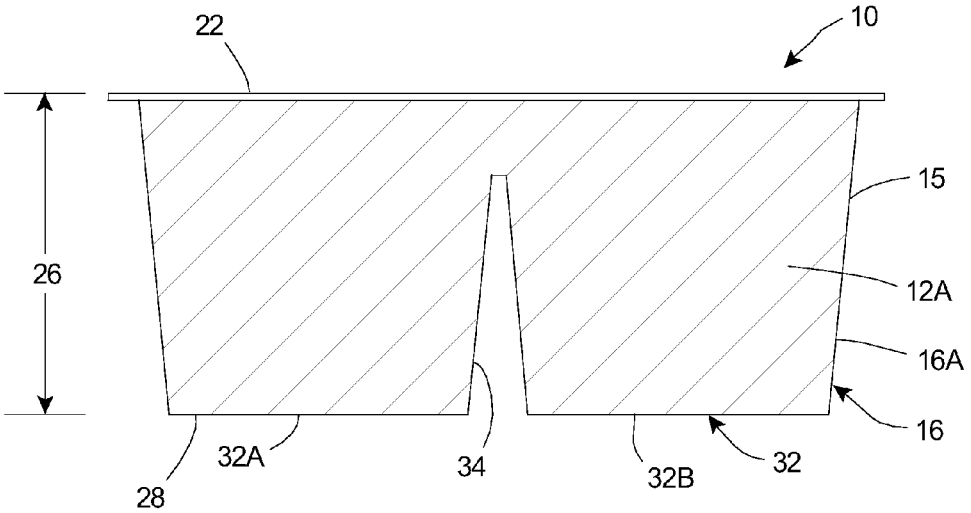
FIG. 1C is a simplified end view of the wax melt assembly illustrated in FIG. 1A.

FIG. 1C is a simplified end view of the wax melt assembly 10 illustrated in FIG. 1A. In particular, FIG. 1C illustrates an end view looking at the first wax melts 12A (illustrated with single diagonal lines) that are retained within the first compartment 16A.

In certain embodiments, each of the compartments 16 can include and/or be subdivided into a plurality of sub-compartments 32. For example, as illustrated, the first compartment 16A can include a first sub-compartment 32A and a second sub-compartment 32B. Somewhat similarly, although not specifically illustrated in FIG. 1C, the second compartment 16B (illustrated in FIG. 1A) can also include a first sub-compartment and a second sub-compartment; and the third compartment 16C (illustrated in FIG. 1A) can also include a first sub-compartment and a second sub-compartment. Alternatively, one or more of the compartments 16 can include more than two sub-compartments. For example, in different embodiments, one or more of the compartments 16 can include three, four, five, six, or another suitable number of sub-compartments. Still alternatively, one or more of the compartments 16 can not be subdivided into any sub-compartments.

As illustrated in FIG. 1C, to allow for the first compartment 16A to include and/or be divided into the plurality of sub-compartments 32, i.e. into the first sub-compartment 32A and the second sub-compartment 32B, the first compartment 16A of the retainer body 15 can include a pair of interior side walls 34 that form and/or define a portion of the each of the individual sub-compartments 32A, 32B. As utilized herein, an "interior side wall" is a wall of the sub-compartment 32 that faces, is substantially directly adjacent to and/or is coupled to a wall of an adjacent sub-compartment 32 within a given compartment 16 of the retainer body 15. Additionally, as illustrated, each interior side wall 34 extends less than the entire distance from the base 28 of the retainer body 15 to the top 22 of the retainer body 15. Stated in another manner, the interior side walls 34 extend less than the total height 26 of the retainer body 15. In different embodiments, the interior side walls 34 can extend upward from the base 28 of the retainer body 15 between approximately one-half and nine-tenths of the total height 26 of the retainer body 15. For example, in certain non-exclusive alternative embodiments, the interior side walls 34 can extend upward from the base 28 of the retainer body 15 approximately one-half, five-eighths, two-thirds, three-quarters, seven-eighths, nine-tenths, or some other portion of the overall height 26 of the retainer body 15. With this design, as shown in FIG. 1C, the interior side walls 34 enable two first wax melts 12A to be positioned and/or formed adjacent to and removably coupled to one another. Further, when it is desired to use one of the first wax melts 12A, the first wax melts 12A can be removed from the retainer body 15 and one of the first wax melts 12A can be easily broken off from or removed from the other first wax melt 12A. Additionally and/or alternatively, one of the first wax melts 12A can be broken off from or removed from the other wax melt 12A without first removing the first wax melts 12A from the retainer body 15.

Additionally, it should be understood that since the compartments 16 being spaced apart from one another enables the first wax melts 12A to be spaced apart from the second wax melts 12B (illustrated in FIG. 1A) and the third wax melts 12C (illustrated in FIG. 1A), the first wax melts 12A can be individually or collectively removed from the retainer body 15 without disturbing and/or removing the other wax melts 12B, 12C from the retainer body 15.

In the embodiment specifically illustrated and described herein in relation to FIGS. 1A-1C, the retainer body 15 includes three individual compartments 16, with each individual compartment 16 including two sub-compartments 32. With this design, the retainer body 15, i.e. the compartments 16 and sub-compartments 32 of the retainer body 15, enables the wax melt assembly 10 to include two first wax melts 12A, two second wax melts 12B and two third wax melts 12C to be simultaneously retained within the retainer body 15 in a 3×2 array. In alternative embodiments, the retainer body 15 can include compartments 16 and/or sub-compartments 32 that allow for wax melts 12 to be simultaneously retained within the retainer body 15 in a 1×2, 1×3, 1×4, 1×5, 1×6, 2×2, 2×3, 2×4, 2×5, 2×6, 3×3, 3×4, 3×5, 3×6, 4×4, 4×5, 4×6, 5×5, 5×6, 6×6, or some other size array.

While a number of exemplary aspects and embodiments of a wax melt assembly 10 and a melt retainer 14 have been discussed above, those skilled in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A wax melt assembly comprising:

a plurality of first wax melts each having a first property;

a plurality of second wax melts each having a second property that is different than the first property; and a melt retainer including a first compartment that is adapted to retain the first wax melts and a spaced apart second compartment that is adapted to retain the second wax melts, the first compartment including (i) a first sub-compartment that is adapted to retain one of the first wax melts, and (ii) a second sub-compartment that is adapted to retain another of the first wax melts;

wherein the first wax melt in the first sub-compartment and the first wax melt in the second sub-compartment are directly connected to one another.

2. The wax melt assembly of claim 1 wherein the melt retainer includes a retainer body, the retainer body having a height that extends from a base to a top of the retainer body, and wherein the retainer body includes a plurality of exterior side walls that extend substantially the entire height of the retainer body, the exterior side walls defining at least a portion of each of the first compartment and the second compartment.

3. The wax melt assembly of claim 2 wherein the retainer body includes a compartment separator that extends between the first compartment and the second compartment to maintain the first compartment spaced apart from the second compartment.

4. The wax melt assembly of claim 1 wherein the melt retainer includes a retainer body, the retainer body having a first interior side wall that defines a portion of the first sub-compartment and a second interior side wall that defines a portion of the second sub-compartment.

5. The wax melt assembly of claim 4 wherein the retainer body has a height that extends from a base to a top of the retainer body, and wherein each of the first interior side wall and the second interior side wall extend between approximately one-half and nine-tenths of the total height of the retainer body.

6. The wax melt assembly of claim 5 wherein the first interior side wall is coupled to the second interior side wall.

7. The wax melt assembly of claim 1 further comprising a plurality of third wax melts each having a third property that is different than the first property and the second property, and wherein the melt retainer further includes a third compartment that is spaced apart from the first compartment and the second compartment, the third compartment being adapted to retain the plurality of third wax melts.

8. The wax melt assembly of claim 1 wherein the first property includes a first scent and the second property includes a second scent that is different than the first scent.

9. The wax melt assembly of claim 1 wherein the first property includes a first color and the second property includes a second color that is different than the first color.

10. The wax melt assembly of claim 1 wherein the melt retainer includes a retainer body that is made from plastic.

11. The wax melt assembly of claim 1 wherein each of the plurality of first wax melts can be individually removed from the first compartment, and wherein each of the plurality of second wax melts can be individually removed from the second compartment.

12. The wax melt assembly of claim 1 wherein the first compartment is adapted to removably retain the first wax melts, and wherein the second compartment is adapted to removably retain the second wax melts.

13. A method comprising the steps of:

retaining a plurality of first wax melts each having a first property in a first compartment of a retainer body, the first compartment including (i) a first sub-compartment that is adapted to retain one of the first wax melts, and (ii) a second sub-compartment that is adapted to retain another of the first wax melts, wherein the first wax melt in the first sub-compartment and the first wax melt in the second sub-compartment are directly connected to one another; and retaining a plurality of second wax melts each having a second property that is different than the first property in a second compartment of the retainer body that is spaced apart from the first compartment.

14. The method of claim 13 wherein the retainer body has a height that extends from a base to a top of the retainer body, and wherein the retainer body includes a plurality of exterior side walls that extend substantially the entire height of the retainer body, the exterior side walls defining at least a portion of each of the first compartment and the second compartment.

15. The method of claim 14 wherein the retainer body includes a compartment separator that extends between the first compartment and the second compartment to maintain the first compartment spaced apart from the second compartment.

16. The method of claim 13 wherein the retainer body has a first interior side wall that defines a portion of the first sub-compartment and a second interior side wall that defines a portion of the second sub-compartment, wherein the retainer body has a height that extends from a base to a top of the retainer body, and wherein each of the first interior side wall and the second interior side wall extend between approximately one-half and nine-tenths of the total height of the retainer body.

17. The method of claim 16 wherein the first interior side wall is coupled to the second interior side wall.

18. The method of claim 13 further comprising retaining a plurality of third wax melts in a third compartment of the retainer body that is spaced apart from the first compartment and the second compartment, the plurality of third wax melts each having a third property that is different than the first property and the second property.

19. The method of claim 13 wherein the retainer body is made from plastic.

20. The method of claim 13 further comprising individually removing each of the first wax melts from the first compartment, and individually removing each of the second wax melts from the second compartment.

21. The method of claim 13 wherein retaining a plurality of first wax melts includes removably retaining the plurality of first wax melts in the first compartment, and wherein retaining a plurality of second wax melts includes removably retaining the plurality of second wax melts in the second compartment.

* * * * *